US009014402B2

(12) United States Patent
Terpstra et al.

(10) Patent No.: US 9,014,402 B2
(45) Date of Patent: Apr. 21, 2015

(54) ACOUSTICALLY ISOLATED PARABOLIC SOUND PICKUP ASSEMBLY

(75) Inventors: Paul Terpstra, Janesville, WI (US); Patrick Santini, West Bend, WI (US)

(73) Assignee: Klover Products, Inc., Janesville, WI (US)

( * ) Notice: Subject to any disclaimer, the term of this patent is extended or adjusted under 35 U.S.C. 154(b) by 0 days.

(21) Appl. No.: 13/472,559

(22) Filed: May 16, 2012

(65) Prior Publication Data

US 2013/0308813 A1 Nov. 21, 2013

(51) Int. Cl.
*H04R 1/34* (2006.01)
*H04R 1/02* (2006.01)

(52) U.S. Cl.
CPC ..... *H04R 1/02* (2013.01)

(58) Field of Classification Search
CPC ..... H04R 1/08; H04R 1/086; H04R 1/32; H04R 1/326; H04R 1/34; H04R 1/30; H04R 1/342; H04R 1/16; H04R 1/18; H04R 1/20; H04R 1/28; H04R 1/2869; H04R 1/2876; H04R 1/2892; H04R 1/42; H04R 19/04
USPC ..... 381/91, 334, 361, 364, 368, 71.7, 336, 381/366
See application file for complete search history.

(56) References Cited

U.S. PATENT DOCUMENTS

| | | | | |
|---|---|---|---|---|
| 2,017,122 | A | 10/1935 | Hanson | |
| 2,049,586 | A | 8/1936 | Hanson | |
| 2,228,024 | A | 1/1941 | Abrahams | |
| 3,483,940 | A | 12/1969 | Weisenthal | |
| 3,723,962 | A * | 3/1973 | Hotchner | 181/125 |
| 3,881,056 | A | 4/1975 | Gibson | |
| 4,037,052 | A | 7/1977 | Doi | |
| 4,264,790 | A | 4/1981 | Zlevor | |
| D324,219 | S | 2/1992 | Besasie | |
| D356,090 | S * | 3/1995 | Russell | D14/231 |
| 5,420,762 | A * | 5/1995 | Lewis | 362/549 |
| 5,452,364 | A | 9/1995 | Bonham | |
| 6,408,080 | B1 | 6/2002 | Koizumi | |
| 7,708,440 | B2 * | 5/2010 | Hamada et al. | 362/547 |
| 8,169,375 | B1 * | 5/2012 | Conrad | 343/713 |
| 2004/0114778 | A1 | 6/2004 | Gobeli | |
| 2007/0183607 | A1 * | 8/2007 | Andrews et al. | 381/160 |

OTHER PUBLICATIONS

Morgan, Tim; The Parabolic Revolution; Oct. 2011; Ferroproductions.com; Retrieved from the Internet: http://www.ferroproductions.com/the-parabolic-revolution/.*

(Continued)

*Primary Examiner* — Ahmad F Matar
*Assistant Examiner* — Sabrina Diaz
(74) *Attorney, Agent, or Firm* — Johnson Legal, PLLC

(57) ABSTRACT

An acoustically isolated support and handle system for a sound pickup system includes vibrationally isolated, releasable connections for an adjustable microphone adapter in front of the reflector and for a pair of support handles and optionally a universal mounting bracket at the rear of the reflector. The handles provide a connection bracket for the optional use of a neck strap that would allow an operator to shift at least a portion of the weight of the device to the operator's neck and back while also providing the option for handheld aiming.

15 Claims, 7 Drawing Sheets

(56) References Cited

OTHER PUBLICATIONS

Big Ears Parabolic Reflector; Retrieved on Apr. 19, 2013; Canford.co.uk; Retrieved from the Internet: http://www.canford.co.uk/ProductResources/ig/2596.pdf.*

Broadcast Big Ears Products; Retrieved on Apr. 19, 2013; Parabs.com; Retrieved from the Internet: http://www.parabs.com/Broadcast/BroadcastBigEars.htm.*

JonyShot Parabolic Microphone; 2007; JonyJib.com; Retrieved from the Internet: http://www.jonyjib.com/jonyshot.htm.*

* cited by examiner

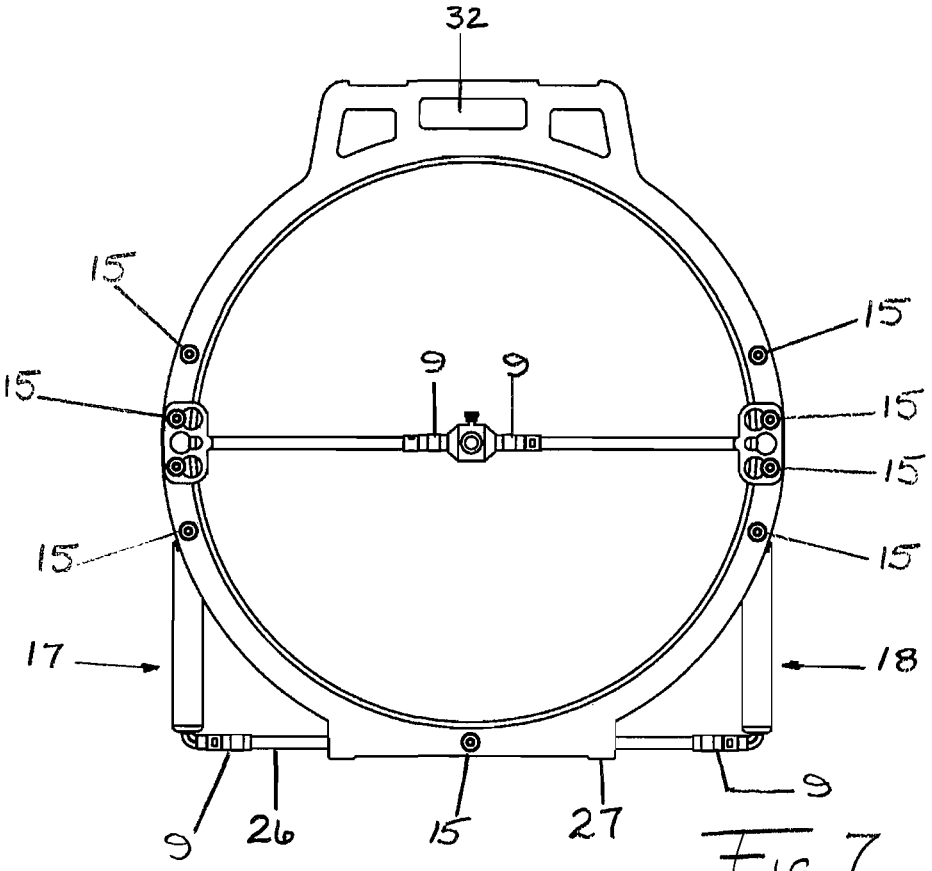
Fig 7
Fig 8
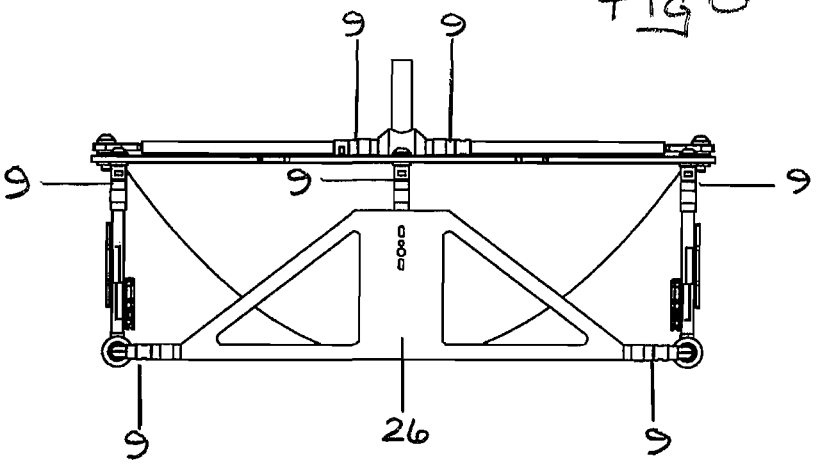

ACOUSTICALLY ISOLATED PARABOLIC SOUND PICKUP ASSEMBLY

FIELD OF THE INVENTION

The invention relates to a generally parabolic reflector and microphone system with an improved assembly design to isolate external vibrations, improve safety and provide faster setup.

BACKGROUND OF THE INVENTION

Parabolic microphone systems, a general term denoting audio capture systems using a central microphone in front of a curved, rear reflector that may exhibit a wide variety of shapes but designed to concentrate and focus audio information at the microphone, have been used in a wide variety of circumstances by military, fire/rescue and broadcast companies. The benefits and advantages of concentrating sounds in a highly directional manner has become a common tool for remote reconnaissance, monitoring, assessment and lost sound capture. See U.S. Pat. Nos. 2,017,122, 2,049,586, 2,228,024, 3,483,940, 3,881,056, 4,037,052, 4,264,790, 5,452,364, and 6,408,080 the disclosures of which are hereby incorporated by reference.

Parabolic microphone assemblies can be found commercially from several vendors. The support designs of each fall into one of a limited number of categories. The first is a pole-mountable frame with a vertically-oriented cylindrical tube rigidly welded to a tubular frame with arms that extend around the back of the parabolic reflector and is secured to a planar lip formed around the perimeter of the reflector. A microphone mounting assembly extends across the front of the reflector between the support frame arms and is similarly secured to the lip of the reflector.

A second type of parabolic reflector support is based on a pair of vertically-oriented, tubular handles with a pair of arms extending from the vertical handle. Each arm is secured to a point on the lip of the reflector so an operator must use both hands to support and aim the reflector to capture the desired sounds. The microphone support extends across the front of the reflector and attaches to the lip of the reflector at a location intermediate the points of attachment for each handle.

A third type of parabolic reflector support uses a single handgrip at the rear of the reflector from which the microphone assembly extends into the parabolic field through a hole in the reflector.

In each of the embodiments, plastic components are typical to save weight and provide resistance to wet conditions.

Parabolic microphones are a staple for broadcast companies at sporting events to capture game sounds for re-broadcast to fans. The proximity to the action on the field coupled with occasional extreme temperatures can subject an operator and his equipment to crushing, accidental collisions with players who are unaware of the operator and to cold temperatures that render plastic components brittle. Indeed, sideline collisions are common and the brittle nature of plastic components is well known. The combination creates a very real potential for fractured support frame tubes to form sharp, plastic, spear-like edges that pose a safety hazard to operators and players. It would be beneficial to have a parabolic support and manipulation system that would allow an operator to directionally aim the reflector but which was made of tough, weather-resistant materials that would remain tough and resistant to shattering or splintering even after exposure for extended period to sub-freezing atmospheric conditions and would crush or collapse if exposed to excessive forces.

Of course, the purpose of on-field parabolic microphones for broadcasters is to concentrate and capture sounds from the field in a highly directional manner. Much attention to this aspect has been directed to the construction details of the microphone or the shape of the parabolic reflector. Very little attention has been directed to the minimization of equipment creaks, squeaks and vibrational interference from the reflector and its support apparatus. Noise can be created by the flexing of its components due to forces applied to the handle or by loads applied to the brackets that support the microphone pickup. It would be desirable to have a parabolic microphone system that could substantially reduce or eliminate vibrational noises from the equipment that might be discernible to the microphone and associated recording system.

For those who use parabolic microphones "in the field", the assembly can be designed for transport as a complete assembly. Completed assemblies are, however, bulky and pose risks of equipment damage during transport at connection points. The more typical design is for transport as components or sub-assemblies that are then assembled on site for use. Traditional designs have, however, relied on tools and fasteners for interconnecting the various parts. This design requires too much time and labor to setup for use and tear down the assemblies for transport. It would be desirable to have a parabolic microphone reflector assembly that could be quickly assembled and disassembled.

SUMMARY OF THE INVENTION

It is an objective of the invention to provide a parabolic sound pickup assembly that is made from durable, weather and temperature resistant materials that resist shattering even at sub-freezing conditions.

It is a further objective of the invention to provide a parabolic reflector and associated support system that is at least substantially eliminates the transmission of creaks, vibrations or noises made by the relative movement of attached parts at connections from the associated audio microphone positioned in front of the reflector.

It is a further objective is to provide a parabolic sound pickup assembly that can be readily assembled and disassembled without tools or loose connectors or fasteners for convenient transport.

Another objective is to provide a support system for the parabolic sound pickup assembly that can be easily modified or adapted to various mounting requirements.

In accordance with these and other objectives of the invention that will become apparent from the description herein, a parabolic sound pickup assembly according to the invention comprises:

a. a generally parabolic, sound reflector having (i) a closed, curved rear side; (ii) an open forward edge having an acoustic center; and (iii) a substantially planar, transverse lip integrally formed along substantially the entire length of said edge and extending outwardly from said acoustic center of said reflector;

b. a support for a first sound pickup microphone, said support comprising (i) a first arm that is releasably secured by a connection to a first site on the reflector lip and extending toward the acoustic center of said reflector, (ii) a second arm attached to a second site by a connection to said reflector lip that is substantially diametrically opposite said first site with said second arm extending toward the acoustic center of said reflector, and (iii) a microphone adapter support near an acoustic focus of said reflecting member and releasably secured to said first arm and said second arm;

c. a pair of handles, each of which is releasably attached to said lip and which extends rearwardly from said lip for a predetermined distance;

whereby each connection between said first arm, said second arm and each of said handles is acoustically isolated from contact with said lip by at least one isolation bushing at each connection.

The acoustic isolation structures provided by the present invention reduce or substantially eliminate the transmission of vibrations, creaks and flexural groans of the reflector and support system that can be transmitted from the equipment to the reflector for detection by the audio microphone system. The result is better sound quality in the recorded sounds with less work by the audio engineer.

The various components of the present sound pickup assembly are made from tough, weather resistant materials and designed for rapid, tool-less assembly and disassembly. The materials of construction provide a durable device that withstands extremes in temperature and ambient weather and provides an enhanced measure of protection for its users against the accidental formation of sharp, splintered edges in the case of accidental collisions and unforeseen hazards.

BRIEF DESCRIPTION OF THE DRAWINGS

FIG. 7 is a front view of the embodiment of FIG. 5.

FIG. 8 is a bottom view of the embodiment of FIG. 5.

DETAILED DESCRIPTION OF THE INVENTION

The present invention is directed to those who work in open or outdoor environments to capture and record audio information. Such operators can include broadcasters of live sporting events, hobbyists who seek to capture wildlife sounds or even military or law enforcement personnel in need of remote surveillance. Such uses require a high degree of sound quality that is not contaminated with extraneous vibrations and noise from the equipment itself.

The present invention has found that a substantial amount of the extraneous equipment noise can be controlled or eliminated by providing a handle that is stable so that the handles cannot flex and force the reflector itself to flex. The handle should also be vibrationally isolated from the reflector using resilient isolation bushings made from an energy absorbing material. Further control is provided with isolation of the microphone pickup device from all other components in the assembly.

Safety and weight considerations are addressed with tough, durable, weather resistant materials of construction. Suitable materials include cured carbon fiber composites (preferred), aluminum and similarly lightweight materials which will not produce sharp edges when crushed.

The wide range of potential applications for parabolic sound pickup systems means that such systems would benefit from an assembly and connection design that would allow for relatively rapid assembly and disassembly, preferably with few or no external tools. Suitable connections include spring-biased connections, push-to-release connections, and twist-to-lock connections. A preferred type of snap connector is "AV 1315 A Aluminum Quick Release" from Bank Fishing Systems, 6302 Rucker Road, Indianapolis, Ind. 46220.

For example, snap connectors can be attached to a perimeter lip on the reflector but vibrationally isolated therefrom with resilient isolation bushings made from natural or synthetic rubber, elastomers, silicone, neoprene or similar materials. These connections would remain attached despite disassembly so as not to tax or place unnecessary wear or flexural forces on the attachments sites on the reflector lip.

The invention is conveniently described with reference to the attached drawings. In this description, similar structures will be designated with the same reference number.

Figure 1:
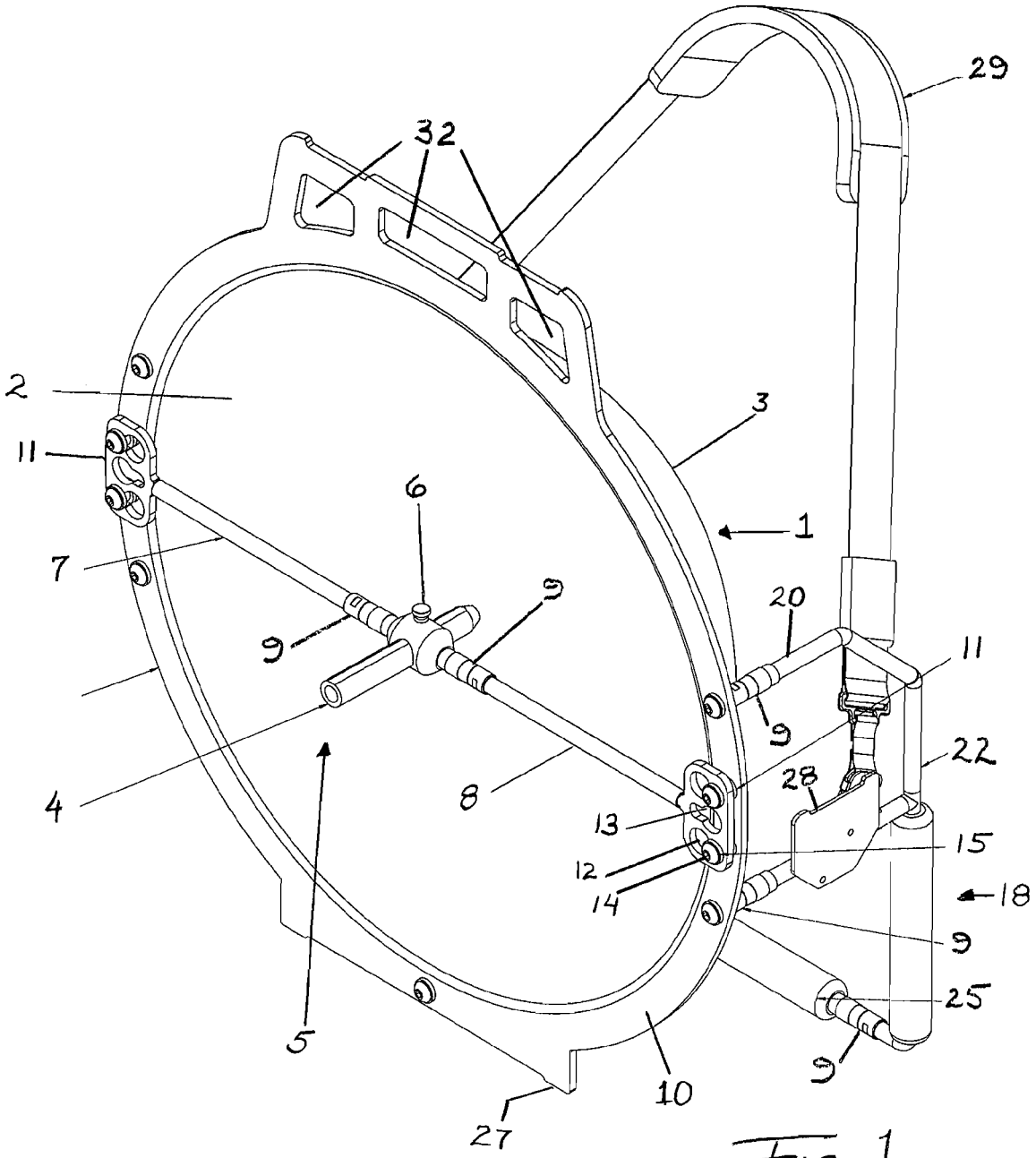
FIG. 1 shows a sound pickup assembly according to the invention with an attached shoulder strap.
Figure 2:
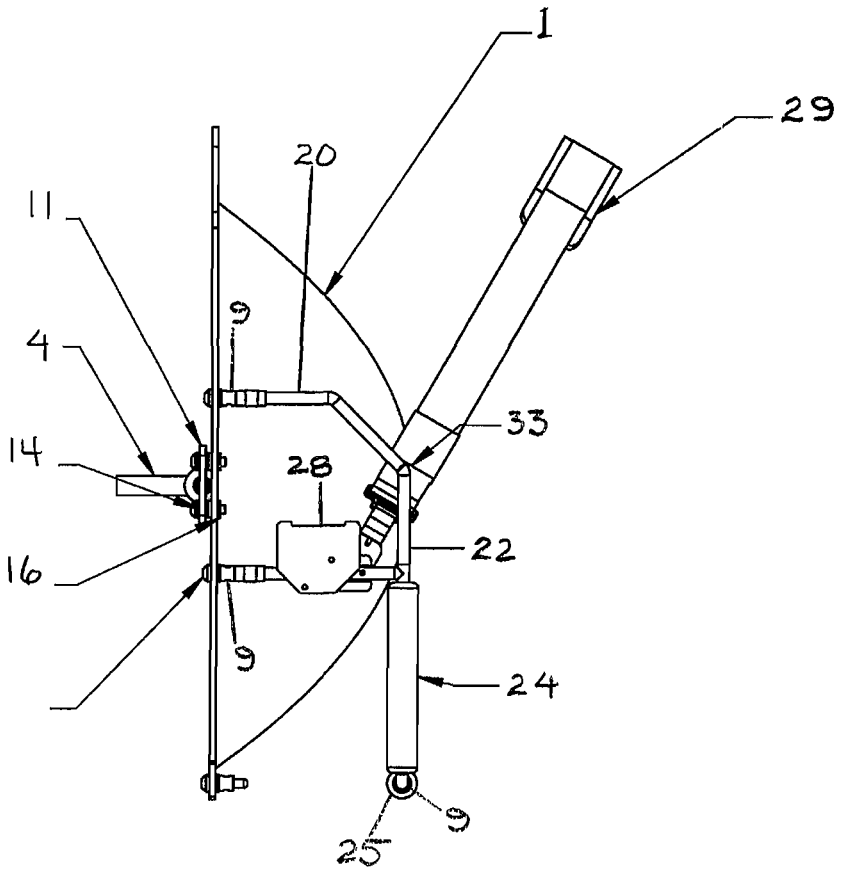
FIG. 2 is a side view of the embodiment of FIG. 1.
Figure 3:
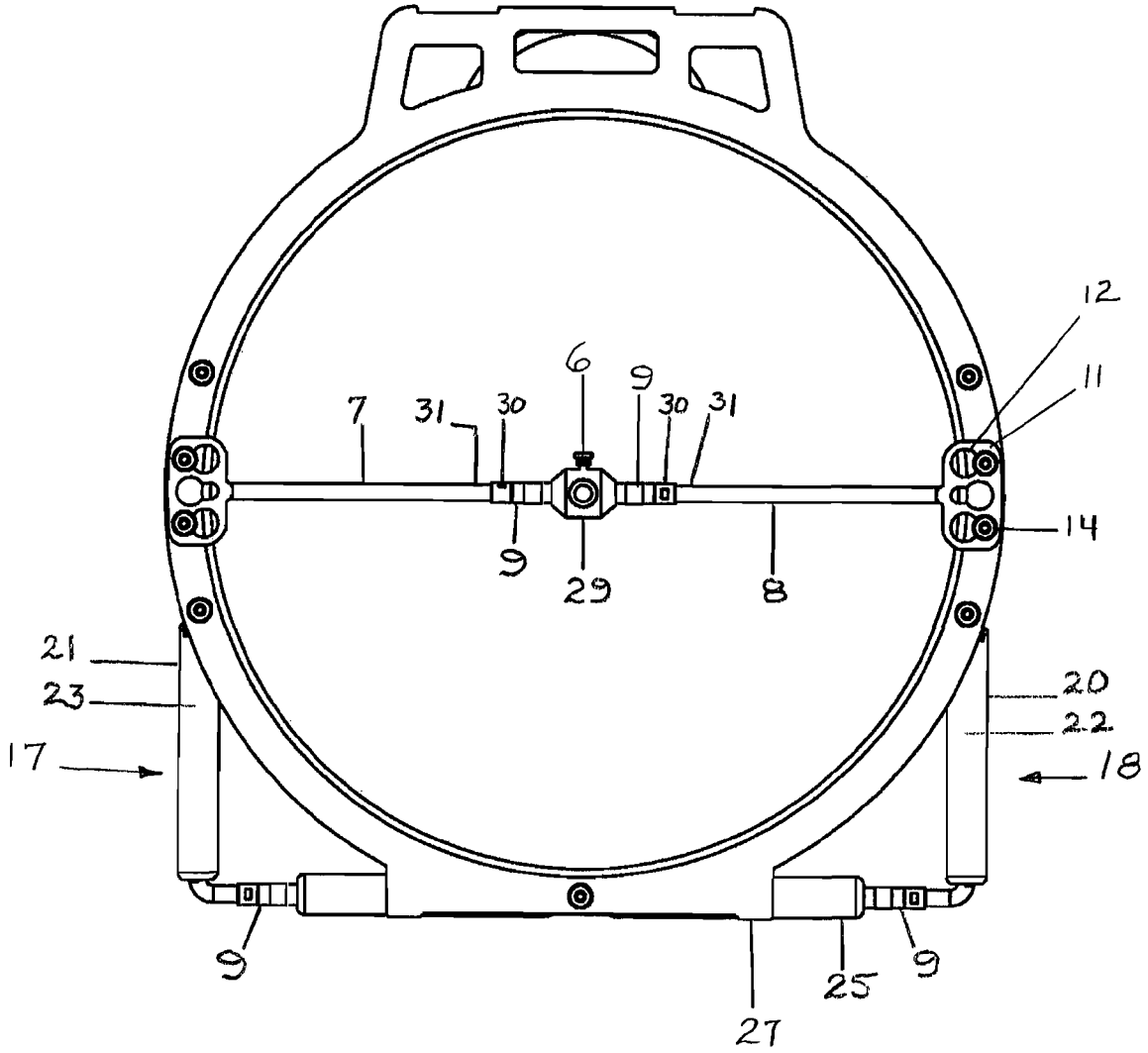
FIG. 3 is a front view of a sound pickup assembly of FIG. 1.
Figure 4:
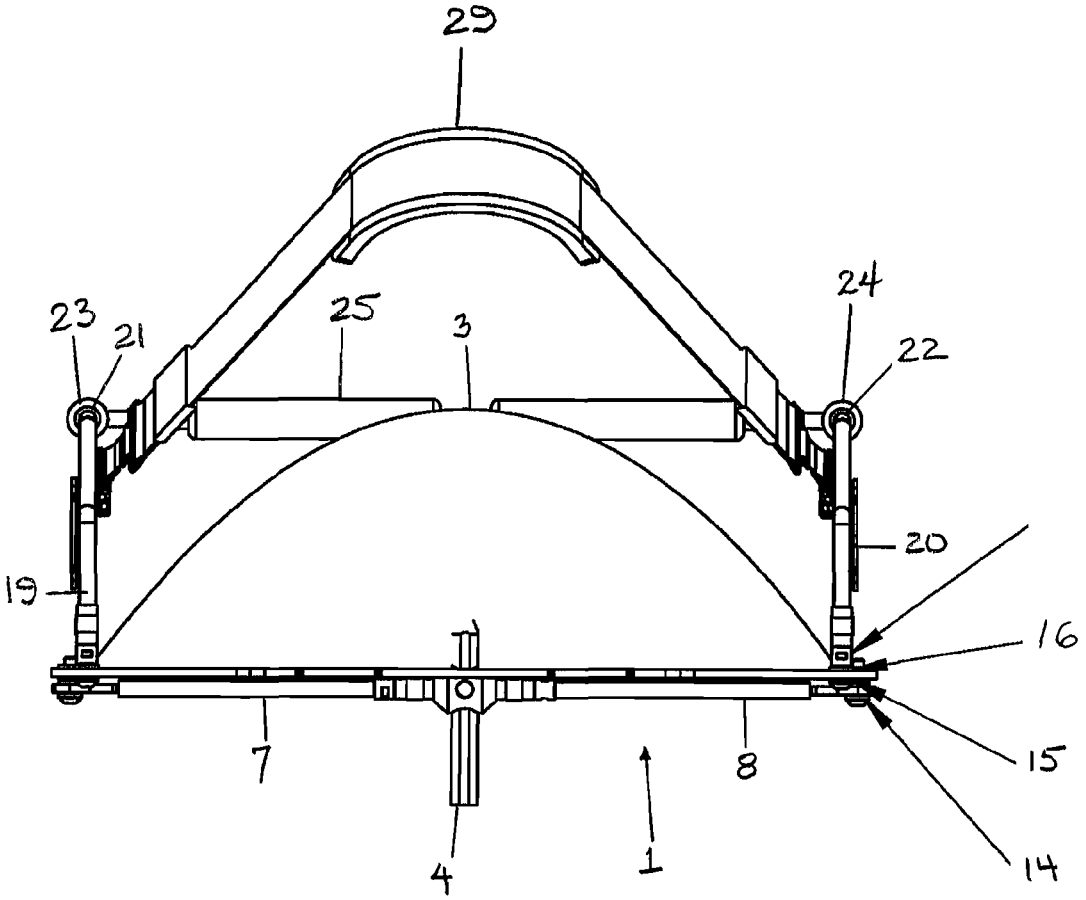
FIG. 4 is a top view of the embodiment of FIG. 1.
Figure 5:
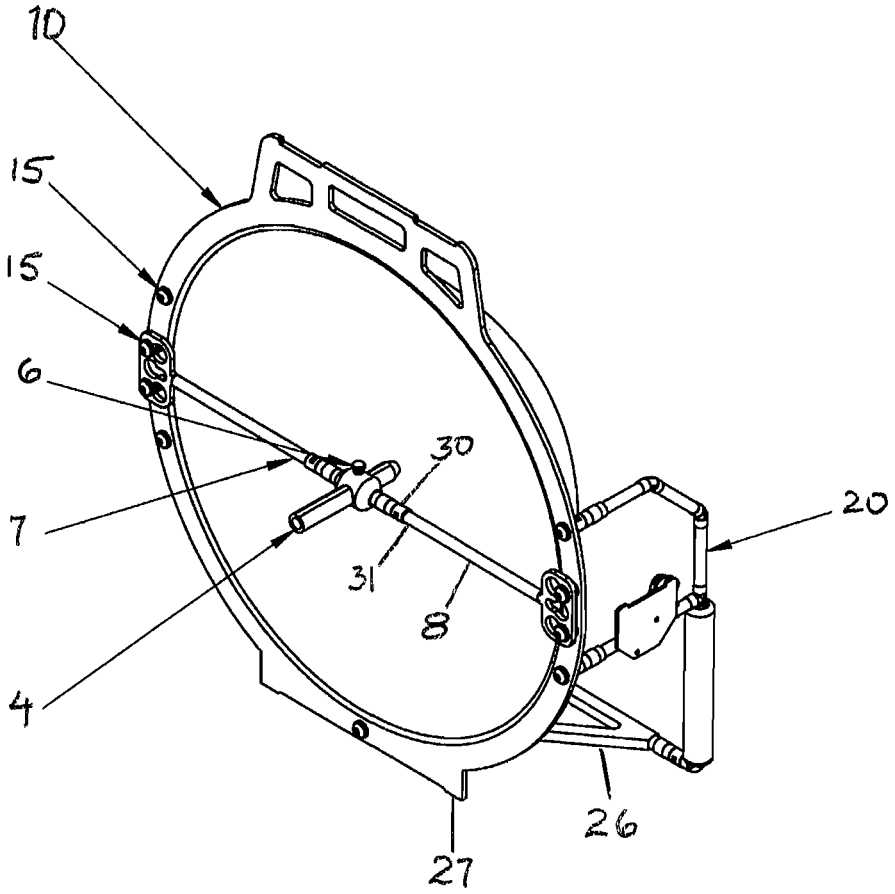
FIG. 5 depicts an alternate embodiment of the sound pickup assembly according to the invention in which a universal mounting plate is attached to the bottom of the handles and to the lip of the parabolic sound reflector thereby forming a stable, three point, acoustically isolated connection.
Figure 6:
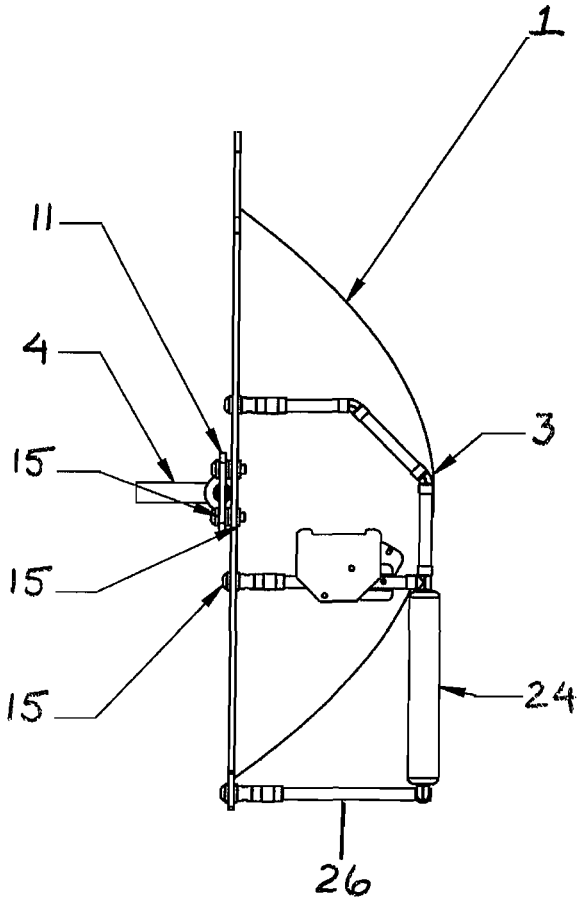
FIG. 6 is a side view of the embodiment of FIG. 5.

As shown in FIG. 1, concave reflector 1 has an open front side 2 and a closed rear side 3. The specific shape is preferably a parabola, but ovoid and other shapes may be used. A parabolic shape is referred to for convenience.

Microphone adapter 4 is positioned at or substantially near the audio focal point 5 of reflector 1. Thumb screw 6 is used to secure a microphone inside adapter 4.

Microphone adapter 4 is releasably secured in position by first arm 7 and second arm 8. The first ends of arms 7,8 connect to adapter 4 with a releasable connection, such as a spring-biased snap connection 9 or a twist-to-lock collar (not shown). The second ends of arms 7,8 extend toward transverse flange lip 10 formed on the front-facing edge of reflector 1.

Keyed connection plates 11 are firmly secured to each second end of arms 7,8. A suitable connection includes an appropriate thermoset adhesive, such as high-impact epoxy. Keyed connection plates 11 each have, as shown in the illustrated embodiment, a pair of generally circular openings 12 near the connection point with arms 7,8. Radial slots 13 extend from openings 12 with a transverse width that is less than the diameter of openings 12. Bolts 14 with resilient isolation bushings 15 are designed and dimensioned to fit through openings 12 and allow arms 7,8 to be displaced inwardly towards adapter 4 in slots 13 so that arms 7,8 may releasably engage snap connections 9 on adapter 4. Bolts 14 and isolation bushings 15 cooperate with nuts 16 and additional isolation bushings 15 to secure arms 7,8 in position with snap connections 9 but acoustically isolating vibrations in these connections from lip 10.

A pair of rear handles 17, 18 allow an operator to steady and aim the reflector during use. Handles 17, 18 attach to the rear of lip 10 with resilient isolation bushings 15 and extend back toward the operator position with one or more horizontal struts 19, 20 that connect to vertically-oriented grips 21, 22. Preferably, grips 21, 22 have cushioning 23, 24 on the vertical grips 21, 22 for the comfort of the operator and to insulate against the transmission of interfering vibrations through handles 17, 18. Preferably, a cross tube 25 is releasably attached to the bottom of each of handles 17, 18 to provide lateral support for handles 17, 18 and to prevent flexure of lip 10 at the connection points of handles 17, 18. Auxiliary attachment plates 28 can be attached to the handle assemblies 17, 18 to provide an attachment site for a neck strap 29 that would allow the weight of the pickup assembly to be carried by the operator's neck and back rather than the operator's arms. Auxiliary attachment plates 28 can also serve as a convenient site for hanging the electronic components (amplifiers, transmitters, transceivers, etc.) that are usually hung on a parabolic microphone support assembly.

FIGS. 5-8 show the optional use of universal mounting bracket 26 between and attached to handles 17, 18. Mounting bracket 26 also includes an acoustically isolated connection with the rear of lip 10 at the typical bottom edge 27 of reflector 1 opposite the formed grip openings 32 in the typical top of lip 10. As shown, bottom edge 27 is formed to provide a relatively straight support surface from lip 10 that helps to arrest the natural tendency of a curved dish reflector to roll or tilt.

Universal mounting bracket 26 represents a further support surface that can be enhanced with threaded tripod connections and/or clamps for use in mounting the sound pickup assembly to a stand or tripod for sound detection and capture in a fixed position. Alternatively, the sound pickup assembly can be rotated so that the universal mounting bracket is on top of the assembly and used to hang the assembly or as a mounting surface for additional audio or video equipment that might also need to be aimed in the same direction as reflector 1.

The parabolic reflector is vacuum formed using normal methods. The preferred method of making the handle assemblies 17, 18 is to secure quick release connectors with a thermoset or other type of durable adhesive into appropriately sized carbon fiber tubes. The joints 33 in the handle assembly may be made using injection molded plastic pipe fittings, copper pipe fittings of the appropriate size or similar connectors that will form a rigid connection between the parts in each handle assembly.

Cross tube 25 is preferably made by securing the quick release connectors into a section of appropriately sized carbon fiber tube with a high impact thermoset resin, such as high impact epoxy. Similarly, the microphone support arms 7, 8 are also made by securing the keyed end plates into one end of a carbon fiber tube and a quick release connector into the other with a high impact epoxy resin. The center connector section 29 of the microphone adapter 4 is made by threading the quick release connectors 30 into machined tubular parts 31 which has been dimensioned to fit the outside diameter of the microphone itself and allow the microphone (not shown) to be inserted into the microphone adapter 4. A small thumb screw 6 is added to retain the microphone within adapter 4.

To assemble the sound pickup assembly, the operator only needs to snap the cross tube 25 into the bottom of the two handle assemblies 17, 18 and then snap the completed handle onto parabolic dish 1. The operator would then snap the first microphone support arm 7 into the center section 29 of the microphone adapter 4, slide the two keyed connection plates 11 onto the locating tubes attached to the parabolic reflector 1 and snap the second arm 8 into the center section 29 of the microphone adapter 4. Because all connectors are vibrationally insulated and isolated from reflector 1 and the microphone adapter 4, all equipment vibrations are isolated.

What is claimed is:

1. A sound pickup assembly comprising:

a. a generally parabolic, sound reflector having (i) a closed, curved rear side; (ii) an open forward edge having an acoustic center; and (iii) a substantially planar, transverse lip integrally formed along substantially the entire length of said edge and extending outwardly from said acoustic center of said reflector;

b. a support for a first sound pickup microphone, said support comprising (i) a first arm that is attached to a first plate connector that is attached by a first connection to the reflector lip at a first site, said first arm extending toward the acoustic center of said reflector, (ii) a second arm that is attached to a second plate connector that is attached to said reflector lip by a second connection at a second site that is substantially diametrically opposite said first site, said second arm extending toward the acoustic center of said reflector, and (iii) a microphone adapter support near an acoustic focus of said reflector and releasably secured to said first arm and said second arm by a third connection selected from the group consisting of spring-biased connections, push-to-release connections, twist-to-lock connections and snap connectors;

c. a pair of handles, each of which is releasably attached to said lip by a fourth and a fifth connection, each of which is selected from the group consisting of spring-biased connections, push-to-release connections, twist-to-lock connections and snap connectors and which extends rearwardly from said lip for a predetermined distance; and d. a universal mounting bracket or cross tube that is releasably attached to and interconnects each of said handles;

whereby each of said first, second, third, fourth, and fifth connections to said reflector lip is acoustically isolated from said lip by at least one resilient isolation bushing at each connection.

2. A sound pickup assembly according to claim 1 wherein each of said handles comprises at least one horizontal strut that extends rearwardly from said lip and into a secured connection with a vertically-oriented gripping member.

3. A sound pick-up assembly according to claim 2 wherein each of said handles comprises two horizontal struts.

4. A sound pick-up assembly according to claim 2 wherein each of said handles further comprises an attachment plate secured to a horizontal strut and by which a neck strap can be secured between said handles.

5. A sound pickup assembly according to claim 2 comprising said universal mounting bracket.

6. A sound pickup assembly according to claim 1 wherein said first arm and said second arm are releasably connected to said microphone adapter support with snap connect fittings.

7. A sound pickup assembly according to claim 6 wherein one of said snap connect fittings engages said first arm when said first arm is laterally displaced from said lip towards the acoustic center of said reflector.

8. A sound pickup assembly according to claim 1 wherein each of said handles is made from a tough, weather-resistant material.

9. A sound pickup assembly according to claim 1 comprising said cross tube.

10. A sound pickup assembly according to claim 1 wherein said first arm of said support for said sound pickup microphone is releasably secured by a snap connector.

11. A sound pickup assembly according to claim 1 wherein said microphone adapter support is releasably secured by at least one of said first arm and said second arm by snap connectors.

12. A sound pickup assembly according to claim 1 wherein each of said handles is releasably secured by a snap connector to said reflector lip.

13. A sound pickup assembly according to claim 1 wherein said universal bracket releasably connects each of said handles and said reflector lip.

14. A sound pickup assembly according to claim 1 wherein said universal bracket is connected to, but acoustically isolated from, said parabolic reflector lip and each of said handles by at least one resilient isolation bushing at each connection so as to form a supporting handle system exhibiting at least three points of contact with said reflector lip.

15. A sound pickup assembly according to claim 1 wherein each of said first and second connector plates removably engage acoustically isolated bolts mounted to said sound reflector lip at said first and second sites.

* * * * *